US008668008B2

(12) United States Patent
Rytlewski et al.

(10) Patent No.: US 8,668,008 B2
(45) Date of Patent: Mar. 11, 2014

(54) ATOMIC BATTERY POWERED DOWNHOLE COMPLETIONS ASSEMBLY

(75) Inventors: Gary Rytlewski, League City, TX (US); Ozgur Pulat, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 145 days.

(21) Appl. No.: 13/150,702

(22) Filed: Jun. 1, 2011

(65) Prior Publication Data

US 2012/0305241 A1 Dec. 6, 2012

(51) Int. Cl.
*E21B 47/12* (2012.01)
*E21B 34/06* (2006.01)

(52) U.S. Cl.
USPC ..... 166/250.01

(58) Field of Classification Search
USPC ..... 166/66, 250.01, 250.15, 313
See application file for complete search history.

(56) References Cited

U.S. PATENT DOCUMENTS

| | | | | |
|---|---|---|---|---|
| 4,879,463 | A | 11/1989 | Wraight | |
| 7,663,288 | B2 | 2/2010 | Chandrashekhar | |
| 2008/0042869 | A1 * | 2/2008 | Zimmerman | 340/853.2 |
| 2008/0081676 | A1 * | 4/2008 | Chakraborty et al. | 455/574 |
| 2009/0067288 | A1 * | 3/2009 | Godager | 367/81 |
| 2009/0135982 | A1 | 5/2009 | Groves | |
| 2009/0146052 | A1 | 6/2009 | Groves | |
| 2011/0031015 | A1 * | 2/2011 | Downton et al. | 175/27 |
| 2011/0035151 | A1 | 2/2011 | Botto | |

* cited by examiner

*Primary Examiner* — William P Neuder
(74) *Attorney, Agent, or Firm* — David J. Groesbeck; Brandon S. Clark

(57) ABSTRACT

A completions assembly having an autonomous self-sustaining portion powered by an atomic battery. The atomic battery may be of a non-based beta voltaic variety configured to provide uninterrupted power to the autonomous portion of the assembly for substantially the life of the well. Thus, continuous monitoring of well conditions or low power actuations, via sensors and/or actuators of the autonomous portion, may be supported. As a result, the autonomous portion may be operated in a fully wireless manner without the requirement of hard wiring to the main bore/surface connected portion of the completions assembly.

17 Claims, 5 Drawing Sheets

ATOMIC BATTERY POWERED DOWNHOLE COMPLETIONS ASSEMBLY

BACKGROUND

Exploring, drilling and completing hydrocarbon and other wells are generally complicated, time consuming and ultimately very expensive endeavors. In recognition of the potentially enormous expense of well completion, added emphasis has been placed on well monitoring and maintenance throughout the life of the well. That is, placing added emphasis on increasing the life and productivity of a given well may help ensure that the well provides a healthy return on the significant investment involved in its completion. Thus, over the years, well diagnostics and treatment have become more sophisticated and critical facets of managing well operations.

In certain circumstances, well diagnostics takes place on a near-continuous basis such as where pressure, temperature or other sensors are disposed downhole. For example, such sensors may be provided in conjunction with production tubing, laterally disposed frac-liners, chemical injection hardware, or a host of other completions equipment. That is, a monitoring tool with sensors may be affixed downhole with the equipment in order to track well conditions over time. In some cases, the monitoring tools may be fairly sophisticated with capacity to simultaneously track a host of well conditions in real-time. Thus, both sudden production profile changes and more gradual production changes over time may be accurately monitored. Such monitoring allows for informed interventions or other adjustments where appropriate.

In many cases, such called-for adjustments may involve minimal actuations such as the opening or closing of a valve, shifting the position of a sliding sleeve or other similarly low-powered maneuvers. As alluded to above, providing completions equipment outfitted with sensors may avoid the introduction of dramatically more costly logging operations. Thus, by the same token, efforts have been undertaken to outfit completions equipment with affixed tools suitable for achieving minimal actuations such as the noted shifting of a sliding sleeve. So, for example, the costly introduction of a separate coiled tubing intervention dedicated to sliding a sleeve may be avoided.

Providing continuous downhole power to completions equipment may face certain challenges. This is particularly the case where the completions equipment is installed throughout various lateral legs of a multi-lateral well, thereby rendering power supply via conventional electrical cable near impossible. For example, in order to supply a separate electrical cable to each lateral leg of a multi-lateral well, cabling may be dropped through a central bore. This results in separate cable lines exiting the bore into each separate lateral leg. Not only does this present significant installation challenges, the well is left with a myriad of cables running into and out of lateral legs and serving as impediments to follow on applications and/or production itself.

In order to avoid the challenges and obstacles presented as a result of power supply via electric cable, efforts have been made to direct actuation tools via hydraulics. So, for example, it may be possible to direct the shifting of a sliding sleeve in a lateral leg through the hydraulics of the well and/or completions equipment without the need to supply a dedicated electric cable to the vicinity of the sleeve. Of course, such efforts may be fairly sophisticated and lack a degree of reliability. Further, such efforts are impractical in terms of supplying power to monitoring tools. Thus, the effectiveness of the shifting of the sliding sleeve would remain unchecked by any associated nearby monitor.

Given the limitations on hydraulic power as noted above, more discrete and dedicated power supplies have been affixed to completions equipment in hopes of supplying necessary power for low-power monitoring and actuation. For example, completions equipment has been outfitted with lithium-based battery packages adjacent monitoring and/or actuation tools. Thus, in the case of a multi-lateral leg of the well, a monitor or actuation tool therein may be supplied with power directly from the associated battery pack.

The power requirements for the noted monitoring or actuations are small enough to be supplied by the indicated lithium-base batteries. Unfortunately, the life of such lithium-based or other conventionally available batteries is dramatically less than the life of the well. For example, in theory, such batteries may have a life ranging from about 2-3 years whereas the life of the well may be closer to 20 on average. Furthermore, in practice, as the batteries are employed and exposed to high temperature downhole conditions, battery life is even further reduced. As a result, operators may undertake repeated interventions for battery change-outs. Alternatively, repeated logging and actuation interventions may be undertaken with the option of discrete independently powered monitoring and actuation tools foregone altogether. Regardless the particular undertaking selected by the operator, the time and expense involved may be quite dramatic.

SUMMARY

A completions assembly is disclosed for installing in a well. The assembly includes one of a sensor and an actuator that is powered by an atomic battery. The battery is equipped for effective supply of power to the mechanisms for an uninterrupted period substantially exceeding about two years.

The noted uninterrupted period may be between about 10 and about 30 years and the atomic battery may be a nano-based beta voltaic battery. Further, a transceiver, transmitter or receiver may also be coupled to the battery to support communications between the mechanisms and equipment at an oilfield accommodating the well.

DETAILED DESCRIPTION

Embodiments are described with reference to certain downhole completions assemblies. In particular, focus is drawn to assemblies which employ upper or main bore completion portions in conjunction with lower or physically independent completion portions disposed throughout various multi-lateral well legs. However, other types and configurations of completions assemblies may take advantage of the embodiments of tools and techniques detailed herein. For example, completions assemblies of non-multi-lateral architecture and even those lacking a physically independent downhole completion portion may nevertheless utilize tools and techniques detailed herein. Regardless, embodiments of assemblies do include an atomic battery of extended life for powering of certain monitoring and low power actuations over the substantial life of the well.

Figure 1:
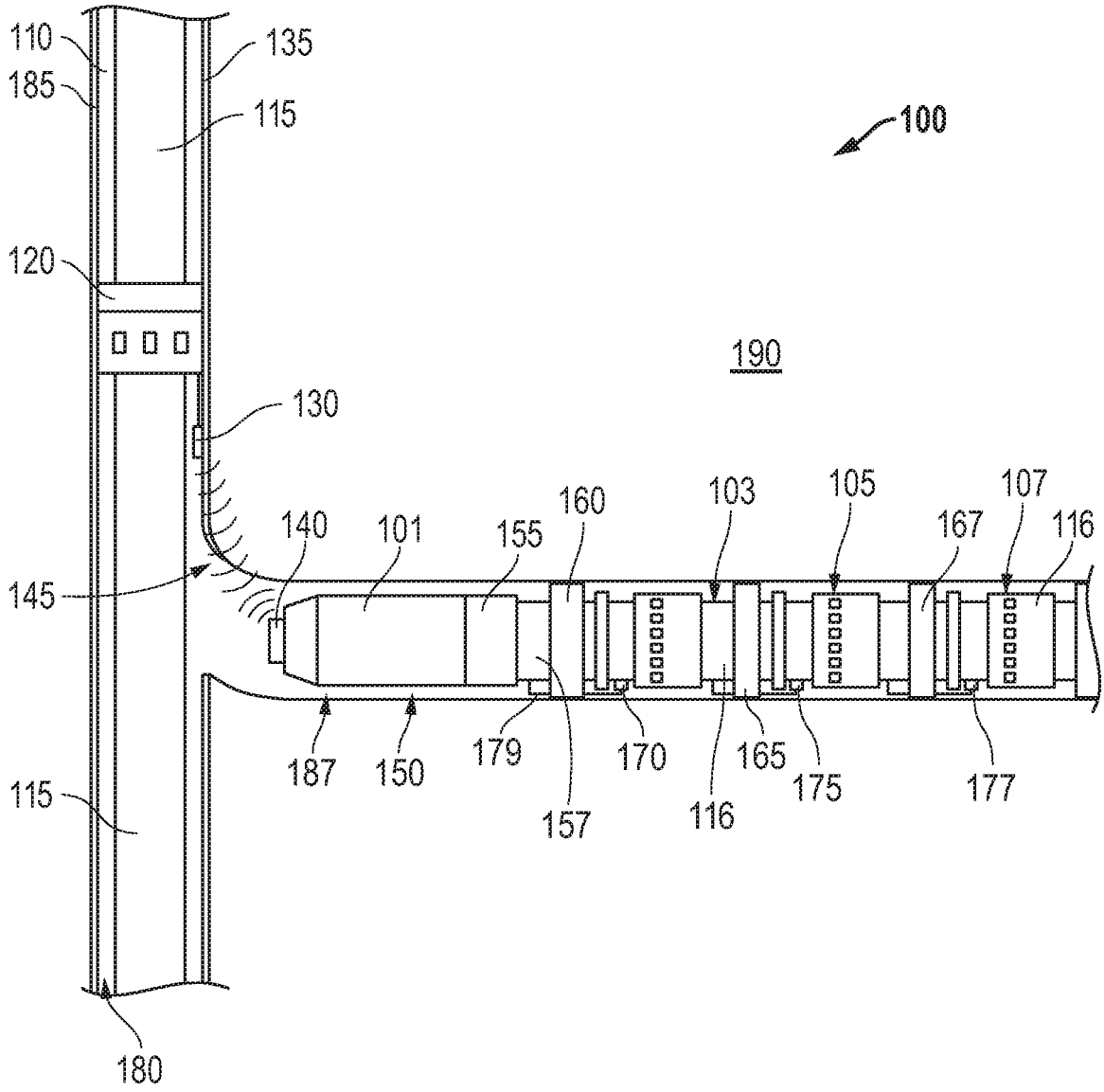
FIG. 1 is a sectional view of an embodiment of a downhole completions assembly in a well with an installed independent portion employing an atomic battery.

Referring now to FIG. 1, a completions assembly 100 is depicted in a well 180. More specifically, the well 180 traverses a formation 190 with its main bore splitting off to a lateral leg 187. Thus, the assembly 100 includes a surface connected or main bore portion 110 and a physically autonomous lateral leg portion 150. In the embodiment shown, the lateral leg 187 and corresponding assembly portion 150 are depicted at about 90° off the main bore 180. However, for sake of implementation, a smaller, say 30° angle or so may be employed with the leg 187 traversing deeper into the formation 190.

The structure of the main bore portion 110 includes features for servicing the main bore of the well 180. Namely, production tubing 115 is anchored therein by way of a packer 120 that is sealingly engaged with casing 185 defining the well 180. Similarly, structure of the leg portion 150 includes its own production tubing 116 anchored by production or isolation packers 160, 165, 167 against the uncased wall of the open-hole lateral leg 187. In the embodiment shown, the isolation packers 160, 165, 167 serve to define different production zones 103, 105, 107 of the lateral leg 187. Thus, uptake of production fluids 400 at each zone 103, 105, 107 may be independently achieved through valves 450 (see FIG. 4A). Once more, monitoring of conditions at each zone 103, 105, 107 as well as actuatable control over the uptake at each zone 103, 105, 107 may be independently achieved as detailed further below.

Continuing with reference to FIG. 1, the leg portion 150 of the assembly 100 is shown independently installed within the lateral leg 187 as noted above. That is to say, this portion 150 of the assembly is physically detached from the main bore portion 110 of the assembly 100. In the embodiment shown, no connecting tubing or other structure is required between the leg portion 150 and the main bore portion 110. Rather, produced fluids, downhole conditions or other well characteristics may be governed and/or monitored by the leg portion 150 as directed through the main bore portion 110 even without physical connection therebetween. By way of example, fluids drawn in by the leg portion 150 may be emptied into the main bore of the well 180 and taken up by the main bore portion 110 of the assembly 100.

The physically independent nature of the separately disposed portions 110, 150 allows for ease of installation and use of the completions assembly 100. Additionally, in the embodiment depicted, this independent nature is further enhanced by the use of wireless telemetry between these portions 110, 150. That is, in addition to avoiding direct tubular connection between the portions 110, 150, use of a physical power and/or data line is also avoided. Such lines may present physical interference and be potentially quite difficult to install. This may be particularly true where the well 180 is multi-lateral in nature and lined power/data telemetry would present a whole host of interweaving physical lines to deal with (see FIG. 2).

In the embodiment shown, the absence of power and data lines running all the way to the lateral portion 150 is replaced with a combination of a self-sustained power source (atomic battery 101) integrated into this portion 150 along with wireless communications thereto (note wireless transmission 145). More specifically, the lateral portion 150 is equipped with the noted atomic battery 101 for meeting power requirements and a lower transceiver 140 for wireless communications (with an upper transceiver 130 of the main bore portion 110). As detailed below, the power requirements met by the battery 101 may relate to monitoring, actuating or even the needs of a wireless communication device such as the lower transceiver 140.

The noted communications may be achieved over conventional radio frequency (RF), Bluetooth or other suitable downhole frequencies. Further, depending on the overall configuration and nature of the assembly 100, the transceivers 130, 140 may include any functional variety or combination of wireless communication devices (i.e. transmitters or receivers). For example, in an embodiment limited to monitoring conditions of the lateral leg 150, the lower transceiver 140 may be no more than a transmitter for one way wireless data transmission to a receiver serving as the upper transceiver 130.

More likely, however, each transceiver 130, 140 would be equipped with both conventional transmitters and receivers for two-way short hop wireless communications. Thus, data from sensors 170, 175, 177 monitoring temperature, pressure, flow and other environmental conditions at zones 103, 105, 107 may be carried uphole over a cable 179 to the lower transceiver 140. This data may then be wirelessly transmitted to the upper transceiver 130 (see 145) and ultimately carried over an upper data line 135 to surface equipment for analysis thereat (see FIG. 2).

Furthermore, upon analysis of such data, signaling from surface may be supported over this same line 135 such that instructions to the upper transceiver 130 may be wirelessly transmitted back to the lower transceiver 140 (see 145). Such data signal may include actuation instructions directed at a conventional low power downhole actuator 157 which may be configured to responsively open or close certain valves in the production zones 103, 105, 107 based on the noted data analysis (see FIGS. 4A & 4B).

As alluded to above, the above described monitoring and actuations which take place at the physically isolated lateral leg portion 150 of the assembly 100 may be powered by an atomic battery 101. More specifically, the atomic battery 101 may be made up of nano-based beta voltaic battery packages as detailed with respect to FIGS. 3A-3C below. As a result, such batteries 101 may not only be suited for use in the downhole environment, but may also be readily configured for an efficient and useful life exceeding about 20 years.

By way of example, a hockey puck like 2-5 inch diameter, 5-15 watt nano-based beta voltaic battery may be configured for continuous power drain suitable for monitoring and actuation applications as described above. A battery of this nature may be constructed according to techniques such as those detailed in U.S. Pat. No. 7,663,288 to Chandrashekhar, et al., incorporated by reference herein in its entirety, although other atomic battery construction techniques may also be utilized. Regardless, the need for battery replacement during the life of the well 180 may be avoided due to the atomic nature of the battery 101. Further, in the embodiment shown, a conventional rechargeable or 'trickle' charge battery 155 is coupled to the atomic battery 101, further ensuring downhole power reliability and life.

In addition to increased life as compared to, say a conventional lithium ion or polymer battery, the described atomic battery 101 also provides enhanced efficiency. For example, the use of a self-sustained power source at the lower assembly portion 150 means that power losses over potentially several thousand feet of line running from surface are completely avoided. Furthermore, where the atomic battery 101 is of a nano-based beta voltaic variety, power efficiency substantially exceeds about 5%, in contrast to an atomic battery that is of a radioactive theremal generator (RTG) variety.

Figure 2:
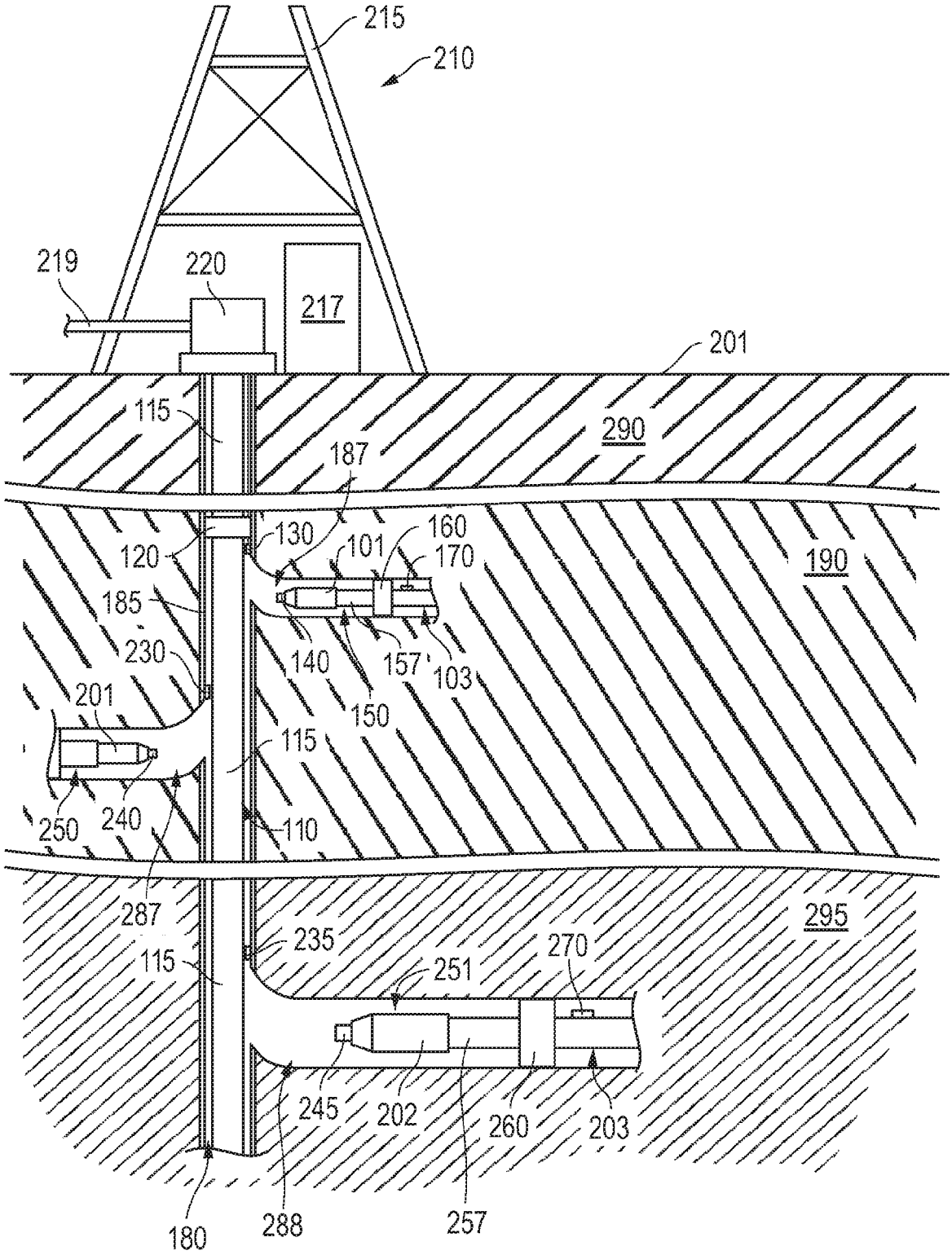
FIG. 2 is an overview depiction of an oilfield accommodating the well and completions assembly of FIG. 1.

Referring now to FIG. 2, an overview of an oilfield 201 is depicted accommodating the well 180 and completions assembly 100 of FIG. 1. In this view, the multi-lateral nature of the well 180 is visible with lateral legs 287, 288 in addition to the lateral leg 187 of FIG. 1. As such, the advantage of avoiding use of a myriad of power/data lines for running to each leg 187, 287, 288 is readily apparent. That is, each leg 187, 287, 288 may be outfitted with a leg portion 150, 250, 251 and a main bore portion 110 of the assembly 100 installed without the need for achieving complex intervening power hookups therebetween. Further, the main bore of the well 180 is left substantially free of electrical line or other encumbrances beyond the intended production tubing 115.

In FIG. 2, the well 180 is shown traversing various formation layers 290, 295 in addition to the layer 190 depicted in FIG. 1. Thus, production may be tailored based on the characteristics of the various layers 190, 290, 295. Further, in governing this production, monitoring of well conditions may be site specific. That is, as described above and depicted in FIG. 2, sensors 170, 270 and actuators 157, 257 may be disposed at leg portions 150, 251 in the various legs 187, 287, 288. Further, power requirements for such low power sensing and actuation may be provided by atomic batteries 101, 201, 202.

In addition to the upper 130 and lower 140 transceivers referenced in FIG. 1, additional upper 230, 235 and lower 240, 245 transceivers may be provided for wireless direction of low power monitoring and actuation at each of the other legs 287, 288 as well. In the embodiment shown, the upper transceivers 130, 230, 235 are disposed at the casing 185. However, for ease of implementation, each of these transceivers 130, 230, 235 may alternatively be disposed at the production tubing 115 along with the data line 135.

Regardless of the particular downhole architectural construct, the oilfield 201 is equipped with a variety of surface equipment 210 which may be utilized in carrying out monitoring and actuation applications as noted above. For example, such applications may be carried out in the context of production operations as depicted in FIG. 2. However, in other embodiments, alternate operations may take advantage of such atomic battery powered self-sustained monitoring and actuation. With specific reference to FIG. 2, a rig 215 is positioned over a well head 220, for example, to support follow-on interventional applications. However, during more typical production, a production fluid 400 may be drawn from the well 180 and transported by a production line 219 for collection (see FIG. 4A).

Continuing with reference to FIG. 2, the surface equipment 210 also includes a control unit 217 which may be employed to acquire and interpret monitored data from a variety of downhole locations which is obtained from the data line 135 (see FIG. 1). Furthermore, in response to data analysis, the unit 217 may also be employed to direct downhole actuations. For example, where water production is sensed at a zone 103, a direction to halt production from such zone 103 may be directed by the unit 217. This direction may be transmitted over the data line 135, and wirelessly between transceivers 130, 140, thereby initiating the actuator 157 to close an uptake valve 450 at the zone 103 (see FIG. 4). As such, the quality of production reaching the production line 219 at surface may be maintained.

Figure 3A:
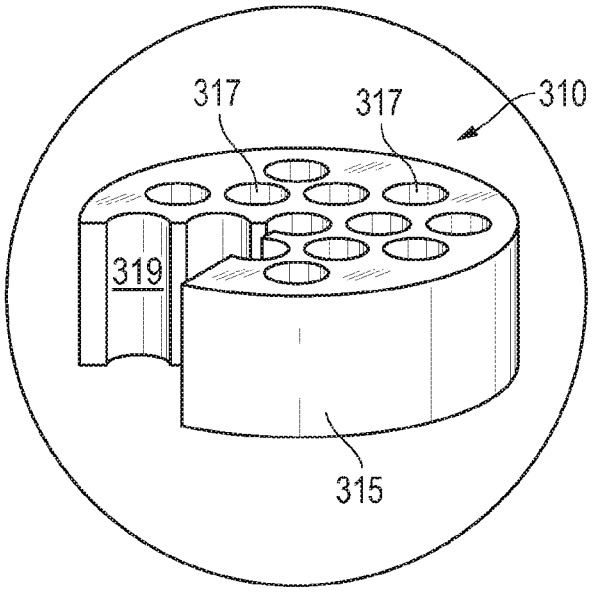
FIG. 3A is an enlarged perspective view of a nano-structured diode portion of the atomic battery of FIG. 1.
Figure 3B:
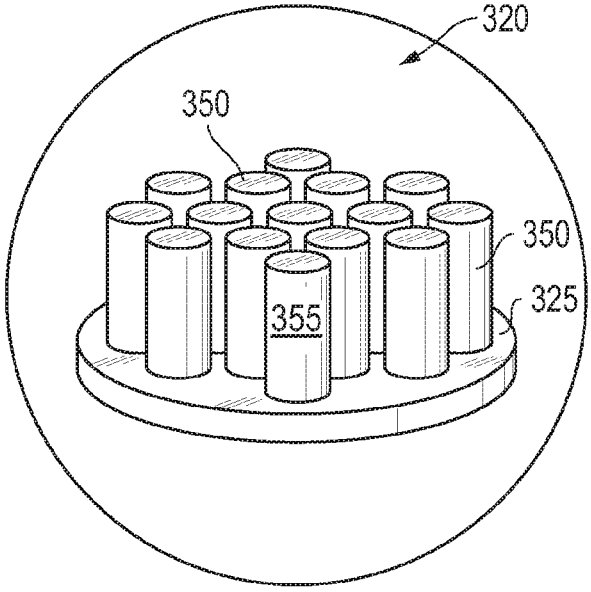
FIG. 3B is an enlarged perspective view of a nano-structured atomic power source of the atomic battery of FIG. 1.
Figure 3C:
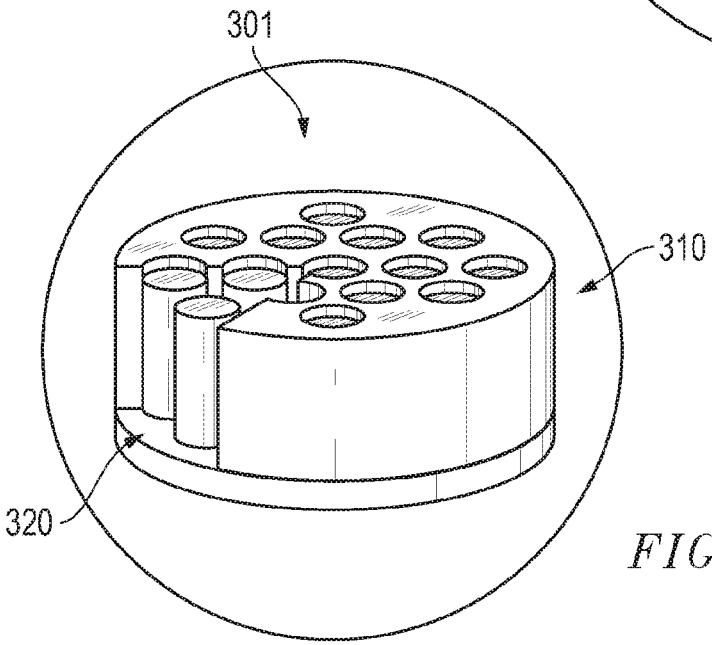
FIG. 3C is an enlarged perspective view of an atomic battery package of the diode and power source of FIGS. 3A and 3B for the atomic battery of FIG. 1.

Referring now to FIGS. 3A-3C enlarged perspective views of different portions of an atomic battery package 301 for supporting self-sustaining downhole monitoring and actuations are depicted. More specifically, FIG. 3A depicts a nano-structured substrate or diode 310 of the atomic battery 101 of FIG. 1 whereas FIG. 3B depicts a nano-structured atomic power source 320 of the atomic battery of FIG. 1. Thus, FIG. 3C reveals a perspective of an atomic battery package 301 which includes the diode 310 and the power source 320 assembled together.

With particular reference to FIG. 3A, the nano-structured diode 310 is depicted in a sectional manner with a main body 315 accommodating a host of chambers 317 therethrough. These chambers 317 are defined by surfaces 319 configured to enhance the surface to volume ratio of adjacently disposed nano-sized power source elements 350 as described below. For example, the diode 310 may be a silicon based material such as silicon carbide suitable for use in conventional semiconductor fabrication techniques. Thus, the micromachined nature of the battery package 301 of FIG. 3C may truly be on the nano-scale, thereby enhancing the noted surface to volume ratio.

With added reference to FIG. 3B, the micro-fabricated surface to volume ratio inherently enhances the efficiency of power capture as a result of the enhanced interface between surfaces 355, 319 of the elements 350 and diode body 315. In the embodiment shown, the elements 350 are rod-like in nature, disposed on a suitable substrate platform 325. However, in other embodiments, spherical or other shapes may be employed. Indeed in one embodiment, a more conventional semiconductor fabrication technique of disposing radioactive source in the chambers 317 or other suitable surface defined gaps of the diode 310 may even be utilized. Such techniques are detailed in the Chandrashekhar reference noted above and incorporated herein by reference in its entirety. Further, whether configured as the rod-like elements 350 depicted or otherwise, the radioactive source employed may be tritium (H3-) or nickel-based, such as nickel 63, although other suitable sources may also be employed.

Referring now to FIG. 3C, the assembly of the diode 310 and power source 320 reveals a workable atomic battery package 301. Such a package 301 may be combined with additional packages as needed for construction of an appropriately sized encased atomic battery 101 of suitable life for continuous downhole use as detailed above.

Figure 4B:
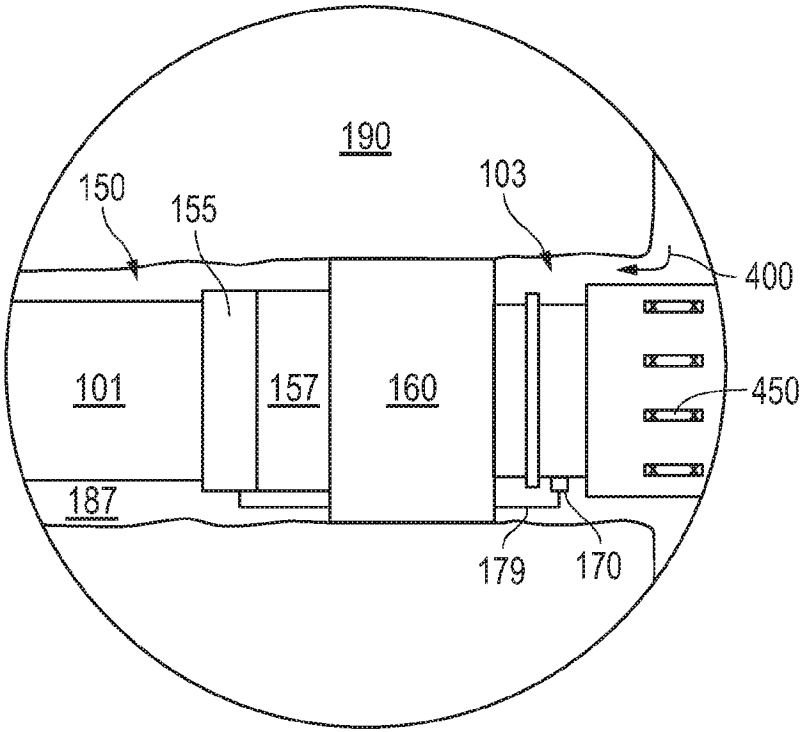
FIG. 4B is an enlarged view of the installed independent portion of the assembly of FIG. 1 with the valve of FIG. 4A closed.
Figure 4A:
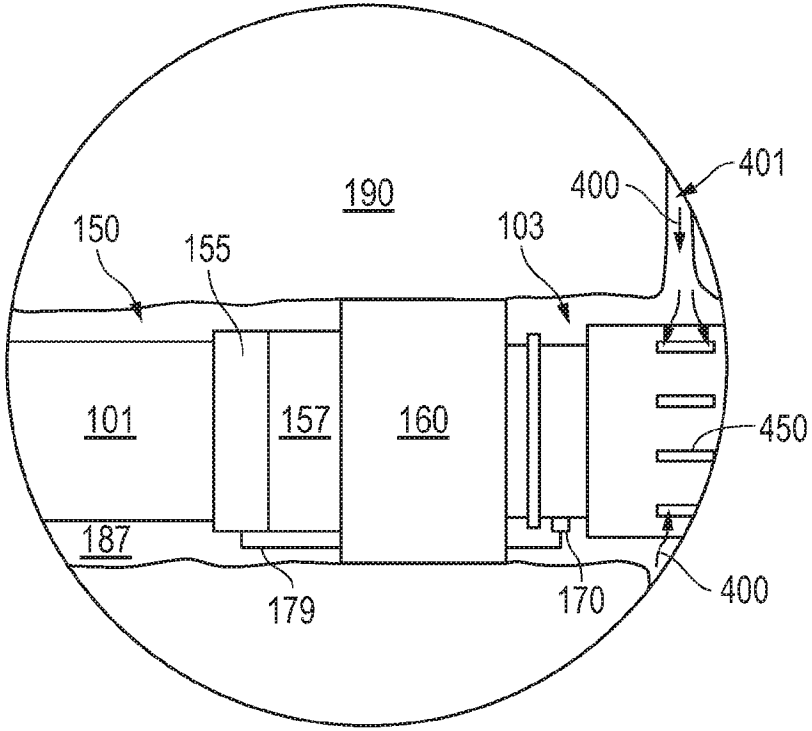
FIG. 4A is an enlarged view of the installed independent portion of the assembly of FIG. 1 with an open valve.

Referring now to FIGS. 4A and 4B, enlarged views of the installed leg portion 150 of the assembly 100 of FIG. 1 are depicted. More specifically, FIG. 4A reveals the intake of production fluid 400 from a perforation 401 in the formation 190 through an open valve 450 of the leg portion 150. Such production takes place within an isolated zone 103 and ultimately results in the transport of the fluid 400 to surface as described above. Once more, during such production, conditions within the zone 103 may be monitored in a self-sustaining manner throughout the life of the well by a sensor 170 which, as detailed above, may be powered by the atomic battery 101.

With particular reference to FIG. 4B, the noted valve 450 may be closed by an actuator 157 of the leg portion 150. So, for example, where water production or other detected conditions emerge calling for a halt in production from the isolated zone 103, responsive action may be directed from surface (e.g. by the control unit 217 of FIG. 2). Thus, in the view of FIG. 4B, the valve 450 is depicted as closed with production fluid 400 unable to enter the leg portion 150 for transport to surface. In one embodiment, the actuator 157 may be a conventional hydrostatic set module for attaining closure of the valve 450. However, in other embodiments, more conventional electro-mechanical mechanisms, electric drive hydraulic pumps or other devices may be employed such as those being more reversible in nature.

Figure 5:
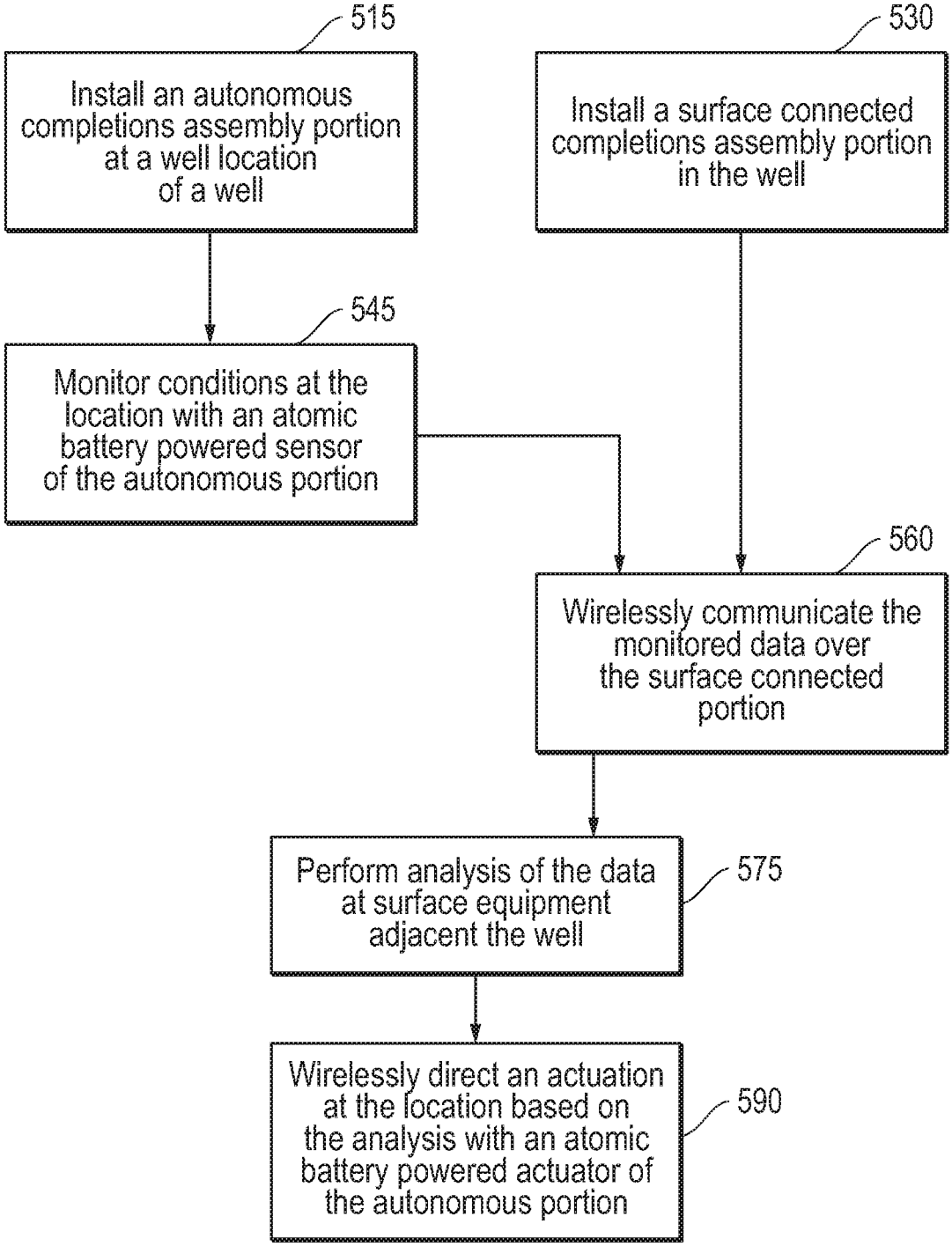
FIG. 5 is a flow-chart summarizing an embodiment of utilizing an atomic battery powered sensor or actuator of an autonomous completions assembly portion.

Referring now to FIG. 5, a flow-chart summarizing an embodiment of employing an autonomous atomic battery powered portion of a completions assembly is shown. As indicated at 515 and 530, the independent or autonomous completions assembly portion is installed in a well along with a separate assembly portion that is connected to surface. The autonomous portion is referenced as autonomous or independent due to a physically detached nature and the self-reliance of power as provided by an atomic battery thereof. Of course, in alternate embodiments, atomic battery power may be incorporated into a less physically detached assembly portion such as a surface connected or main bore portion of a completions assembly.

As indicated at 545, conditions at the well location of the installed autonomous portion may be monitored by an atomic battery powered sensor thereof. The monitored data may be communicated to surface as noted at 560 in a wireless manner over the referenced surface connected assembly portion. Thus, surface equipment adjacent the well may be utilized to keep track of conditions at the location of the autonomous portion. Indeed, analysis of such data may be performed on a substantially real-time basis (see 575). Furthermore, as indicated at 590, such analysis may even lead to the wireless direction of an actuation at the noted well location, such as the opening or closing of a valve thereat, for example, to affect production therefrom. The atomic battery powered actuator employed may rely on the same atomic battery as that of the sensor as noted above or another more particularly tailored to its own power requirements.

Embodiments described hereinabove include completion assemblies employing stand-alone self-sustaining downhole portions that may be sufficiently powered for certain monitoring and/or actuation applications over the life of the well. This is achieved without the requirement of a cumbersome power or data cable running uninterrupted from surface to the downhole portion. This is also achieved without the requirement of repeated battery change outs. Rather, a practical long-life atomic battery may be incorporated into the independent lower completion portion thereby meeting such power requirements throughout the life of the well.

The preceding description has been presented with reference to presently preferred embodiments. However, other embodiments not detailed hereinabove may be employed. For example, wireless telemetry employed over such completions assemblies may take place outside of the main bore or be acoustic or electromagnetic in nature. Further, the atomic battery may also be utilized in conjunction with storage devices in addition to rechargeable battteries such as capacitors for higher power applications over shorter durations. Indeed, persons skilled in the art and technology to which these embodiments pertain will appreciate that still other alterations and changes in the described structures and methods of operation may be practiced without meaningfully departing from the principle and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A downhole completions assembly for installing in a well at an oilfield and comprising:

one of a sensor mechanism, an actuator mechanism and a wireless communication device; and a nano-based beta voltaic battery coupled to one of said mechanisms for effective supply of power thereto for an uninterrupted period exceeding about two years.

2. The assembly of claim 1 wherein the period is greater than about 20 years.

3. The assembly of claim 1 wherein said battery is configured to provide between about 5 watts and about 15 watts.

4. The assembly of claim 1 wherein said battery is of an efficiency substantially exceeding about 5%.

5. The assembly of claim 1 further comprising a trickle-charge battery coupled to said atomic battery for recharge thereof.

6. The assembly of claim 1 wherein said actuator mechanism is of one of an electro-mechanical variety, and an electric drive hydraulic pump.

7. The assembly of claim 1 further comprising a production intake valve for recovering fluid production from the well, said valve coupled to said actuator mechanism for governing thereof.

8. The assembly of claim 1 further comprising:

an autonomous completions portion accommodating said atomic battery and the one of said sensor and actuator mechanisms; and a surface connected completions portion coupled to surface equipment adjacent the well.

9. The assembly of claim 8 wherein the well is a multilateral well and said autonomous completions portion is a first autonomous completions portion, the assembly further comprising a second autonomous completions portion accommodating a second atomic battery and one of a second sensor mechanism and actuator mechanism.

10. The assembly of claim 8 further comprising:

a lower transceiver coupled to said autonomous portion; and an upper transceiver coupled to said surface connected portion and configured for wireless communication with said lower transceiver so as to relay data between the surface equipment and the one of said sensor and actuator mechanisms.

11. The assembly of claim 10 wherein the wireless communication is radio frequency in nature.

12. The assembly of claim 10 wherein the surface equipment comprises a control unit configured for one of monitoring the data, analyzing the data, and directing the actuator mechanism based thereon.

13. A downhole completions assembly for installing in a well at an oilfield and comprising:

one of a sensor mechanism, an actuator mechanism and a wireless communication device; and an atomic battery coupled to one of the mechanisms for effective supply of power thereto for an uninterrupted period exceeding about two years, wherein the battery comprises a radioactive power source accommodated by a silicon-based substrate in a manner enhancing surface to volume ratio of interfacing therebetween.

14. A method of employing a downhole completions assembly in a well, the method comprising:

supplying substantially continuous power to one of a sensor and an actuator of the assembly for substantially the life of the well with an atomic battery;

running a downhole application through the assembly for one of acquiring downhole condition data via the sensor and performing an actuation via the actuator;

installing the autonomous portion in a lateral leg; and installing a surface connected portion of the assembly in a main bore of the well adjacent the lateral leg.

15. The sensor mechanism of claim 14 wherein the sensor is configured to acquire data relative downhole conditions for substantially continuous monitoring thereof.

16. The method of claim 14 wherein the performing of the actuation is based on the data acquired by the acquiring.

17. The method of claim 16 further comprising:

providing the data to a control unit coupled to the surface connected portion in at least a partially wireless manner for analysis thereat; and employing the control unit to direct the performing in at least a partially wireless manner.

* * * * *